US005210967A

United States Patent [19]

Brown

[11] Patent Number: 5,210,967

[45] Date of Patent: May 18, 1993

[54] HIDDEN DISPLAY MIRROR

[76] Inventor: William D. Brown, 3040 SW. 50th St., Ft. Lauderdale, Fla. 33312

[21] Appl. No.: 636,111

[22] Filed: Dec. 31, 1990

[51] Int. Cl.[5] ..... G09F 13/12
[52] U.S. Cl. ..... 40/219; 40/900
[58] Field of Search ..... 40/219, 900, 615, 619, 40/552, 580

[56] References Cited

U.S. PATENT DOCUMENTS

| | | | |
|---|---|---|---|
| 1,141,691 | 6/1915 | Conner et al. | 40/552 |
| 1,407,345 | 2/1922 | Wirsching et al. | 40/619 |
| 1,805,798 | 5/1931 | Bedrossyan | 40/219 X |
| 1,888,584 | 11/1932 | Cadieux | 40/580 |
| 2,056,383 | 10/1936 | Benway | 40/219 |
| 2,114,711 | 4/1938 | Horinstein | 40/219 |
| 2,221,888 | 11/1940 | White | 40/219 |
| 2,782,544 | 2/1957 | Tobin | 40/619 X |
| 3,065,559 | 11/1962 | McKenzie | 40/615 X |

FOREIGN PATENT DOCUMENTS

| | | | |
|---|---|---|---|
| 2205190 | 11/1988 | United Kingdom | 40/219 |

*Primary Examiner*—Kenneth J. Dorner
*Assistant Examiner*—J. Bonifanti
*Attorney, Agent, or Firm*—Richard L. Miller

[57] ABSTRACT

A device which may be transformed from an ordinary mirror to a light emitting graphic display. The front wall is composed of a transparent layer affixed to a reflecting layer. The reflecting layer has a series of narrow grooves passing through describing a graphic image. Since the grooves are thin, most of the reflecting surface remains intact and can perform as a mirror. But upon illuminating the rear surface of the front wall, light emanates from the grooves displaying the graphic design. The light source may be integral to the device or a natural light source may be used. The grooves may be coated with a non-opaque colored stain, or non-opaque sheets of colored material may be affixed to the back surface of the front wall, so that the displayed design will be colored.

8 Claims, 1 Drawing Sheet

HIDDEN DISPLAY MIRROR

BACKGROUND OF THE INVENTION

1. Field of the Invention

This invention relates to artistic displays. More particularly this invention relates to articles which are transformable from an ordinary household article to an artistic display. In particular this invention relates to a device which can function as a mirror and which can be transformed to a light emitting display of graphic designs.

2. Description of the Prior Art

The household mirror has remained in relatively the same form for a long time: a pane of transparent material, such as glass, is coated on one side with a thin layer of a reflecting material, such as silver, and the reflecting material is covered by a protective coating. The protective coating protects the reflective material for accidental impacts which might otherwise injure the reflective material. Though mirrors are commonly mounted in attractive decorative frames, generally the mirror itself does not contain a predetermined artistic design.

Numerous display devices have been provided in the prior art that are adapted to decoratively produce various images. For example, U.S. Pat. Nos. 3,793,755 to Gersch et al; 4,596,083 to Thompson; and 4,832,453 to Saad-Cook all are illustrative of such prior art. While these units may be suitable for the particular purpose to which they address, they would not be as suitable for the purpose of the present invention as hereafter described.

SUMMARY OF THE INVENTION

This invention seeks to provide a device that functions may be transformed from an ordinary mirror to a light emitting display of predetermined graphic designs. On casual inspection, the device simply appears to be an ordinary household mirror. Embodiments of this invention may be produced with common household items and therefore manufacture of the device, in small or large quantities, is relatively inexpensive.

It is therefore an object of this invention to provide a device that functions both as a mirror and as a light emitting display.

It is another object of this invention to provide a light emitting display that is relatively easy and inexpensive to manufacture.

Furthermore it is an object to provide an artistic display that is hidden from view upon casual inspection.

Other features and advantages of the present invention will become apparent from the following detailed description of the preferred embodiments of the present invention with reference to the accompanying drawings.

BRIEF DESCRIPTION OF THE DRAWING FIGURES

The figures in the drawings are briefly described as follows.

DETAILED DESCRIPTION OF THE PREFERRED EMBODIMENTS

Figure 1:
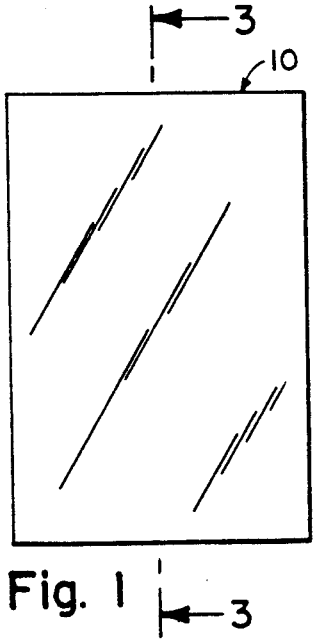
FIG. 1 is a front view of the instant invention with the light off to be used as a mirror.
Figure 2:
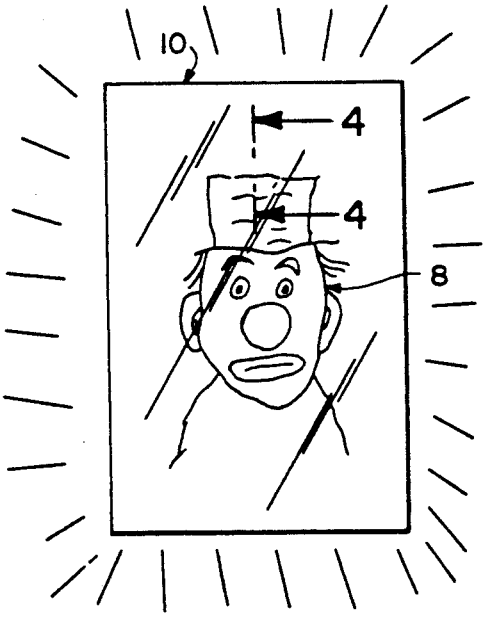
FIG. 2 is a front view of the instant invention with the light on showing a graphic design therethrough, the graphic design being engraved into the reflective material.

The device can either function as a mirror, as suggested in the front view shown in FIG. 1, or as a display of an artistic graphic design 8, as illustrated in the front view of FIG. 2.

Figure 3:
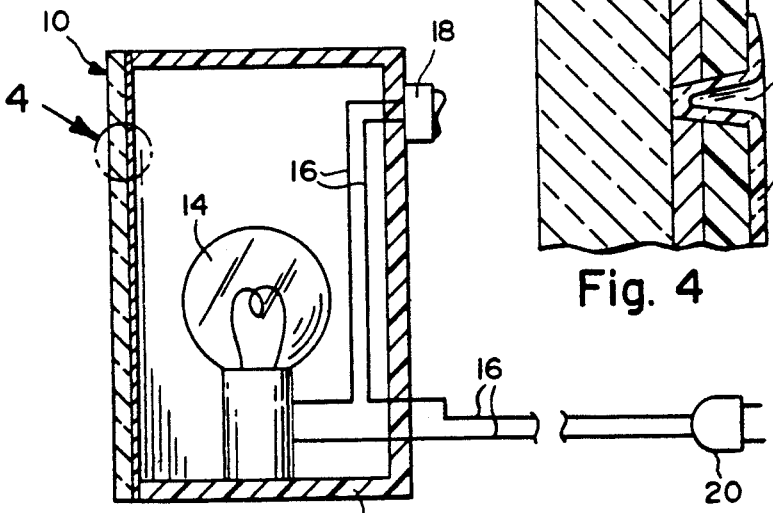
FIG. 3 is a diagrammatic cross sectional view taken on line 3—3 in FIG. 1 illustrating the internal structure thereof.

FIG. 3 shows a cross sectional side view of the device. The front wall 10 is supported by a cabinet 12. The cabinet 12 and front wall 10 encase a light source, in this case the light bulb 14. The light bulb 14 is mounted to the bottom wall of the cabinet 12. The light bulb 14 is connected to a power switch 18 and a standard household electric plug 20 by electric wires 16. The light bulb 14, the power switch 18 and the plug 20 are connected in series. The power switch 18 is mounted to the outside of the back wall of the cabinet 12. The wires 16 to the electric plug 20 extend out from the back wall of the cabinet 12. When the device is plugged in, the power switch 18 turns the light bulb 14 on and off.

Figure 4:
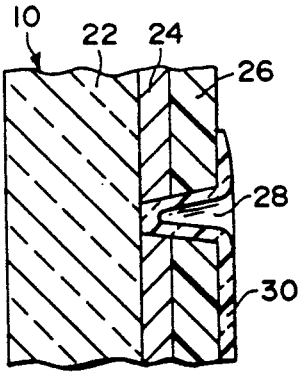
FIG. 4 is an enlarged cross sectional view taken on line 4—4 in FIG. 2 and indicated by arrow 4 in FIG. 3 illustrating how colored stain is applied to the engraved rear surface of the mirror.

Referring of FIG. 4, the reflective front wall 10 of the device is comprised of sheets of several different materials. As is standard for household mirrors, the front layer 22 is a sheet of glass. Affixed behind the front layer 22 is a middle layer 24 of silver. Behind the middle layer 24 is a rear, protective layer 26. The protective layer 26, prevents portions of the middle layer 24 from becoming dislodged from the front layer 22 by accidental impacts from the rear.

Engraved in the rear and middle layers, 26 and 24, is a series of grooves 28 which from the graphic design 8. The grooves 28 extend through both of the rear and middle layers 26 and 24, thereby allowing light to pass through the front wall 10. The grooves 28 may be made in any ordinary mirror by scratching the back surface of the mirror with a sufficiently hard object, or by etching the mirror with a corrosive agent that reacts with the materials in the rear and middle layers, 26 and 24, but not with the front layer 22.

The grooves 28 are narrow enough so as to be almost invisible upon casual inspection from the front of the device. Therefore the device can act as an ordinary mirror. But when the light bulb 14 inside the cabinet 12 is turned on, light passes through the grooves 28 and the transparent front layer 22, so that the engraved graphic design 8 is visible from the front. The visual effect is especially striking in darkened surroundings.

The graphic design 8 need not be a monochrome image. As shown in FIG. 4, non-opaque stains 30 can be applied to the back surface of the front wall 10. When colored non-opaque stain 30 lies within a groove 28 so as to coat the transparent front layer 22 exposed by the groove 28, light passing through the groove 28 is thereby colored. Transparent nail polishes work well as a non-opaque stain 30. By selective application of the non-opaque stain 30, different regions of the graphic design 8 can be different colors.

Figure 5:
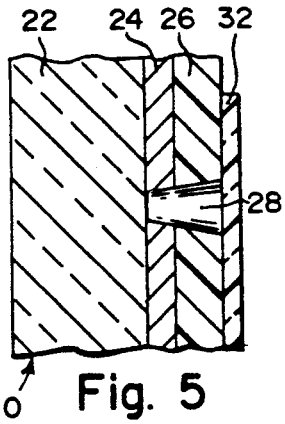
FIG. 5 is an enlarged cross sectional view similar to FIG. 4 showing a transparent colored sheet secured to the engraved rear surface of the mirror.

The design 8 can also be colored by applying colored non-opaque sheets 32 to the back surface of the front wall 10, as shown in FIG. 5. Colored sheets 32 which lie behind a groove 28 color that groove 28. This coloring technique has the advantage that it is easy to color large regions. On the other hand the coloring technique described in the previous paragraph is better suited to coloring proximate regions different colors.

Thus, it will be seen that the improvements presented herein, consistent with the objects of this invention for the hidden mirror display, provide a device that functions both as a mirror and as a light emitting display, provide a light emitting display that is relatively easy and inexpensive to manufacture, and provide an artistic display that is hidden from view upon casual inspection.

While the above description contains many specificities, these should not be construed as limitations on the scope of the invention, but rather as exemplifications of preferred embodiments thereof. Many other variations are possible. For example, the light source for making the graphic design 8 visible may be natural or artificial. The cabinet 12 need not completely enclose the light source. The front layer 22 of the front wall 10 of the device could be made of any transparent material such as crystal or plastic. The middle layer 24 of the front surface 10 could be made of any reflecting material such as copper, aluminum, tin, gold or platinum. Similarly the back, protective layer 26 of the front surface 10 could be made of any hard, durable material. The graphic design 8 could display words, symbols or artistic images. The device may be used for advertising purposes or to display religious imagery. Accordingly, the scope of the invention should be determined not by the embodiments illustrated, but by the appended claims and their legal equivalents.

Having this described the invention what is desired to be protected by Letters Patent is presented by the following appended claims.

What is claimed is:

1. A device comprising:

a) a transparent sheet;

b) a reflecting sheet, said reflecting sheet affixed to the rear surface of said transparent sheet, said reflecting sheet having a narrow groove passing therethrough, the narrow groove describing a graphic design;

c) a light source, the brilliance of said light source being manually controllable, the light source being positioned behind said sheets, so that when the light source has a low level of brilliance the groove is so narrow as to be sufficiently inconspicuous that the graphic design is hidden from view upon casual inspection so that the device may function as an ordinary mirror, and when the light source has a high level of brilliance sufficient light therefrom passes through the groove so that the device acts as a light emitting display of said graphic design.

2. The device in claim 1, further comprising a colored non-opaque material, said non-opaque material positioned so as to intercept light passing through a portion of said groove, so that said portion of said groove is colored when displayed.

3. The device in claim 2, wherein said light source may operate at either a predetermined low level of brilliance or a predetermined high level of brilliance.

4. The device of claim 2, further comprising a protective coating covering the back surface of said reflecting sheet.

5. A device comprising:

a) a transparent sheet;

b) a reflecting sheet affixed to the rear surface of said transparent sheet, said reflecting sheet having a narrow groove passing therethrough, the narrow groove, describing a graphic design, whereby when the rear surface is not illuminated, the groove is so narrow as to be sufficiently inconspicuous that the graphic design is hidden from view upon casual inspection so that the device may function as an ordinary mirror, and when the rear surface of the device is illuminated sufficient light passes through the groove so that the device acts as a light emitting display of said graphic design.

6. The device of claim 5, further comprising a colored non-opaque material, said non-opaque material positioned so as to intercept light passing through a portion of said groove, so that said portion of said groove is colored when displayed.

7. The device in claim 5, further comprising a protective coating covering the back surface of said reflecting sheet.

8. The device of claim 5 wherein the narrow groove has opposite side walls convergent towards the transparent sheet.

* * * * *